US006276851B1

(12) United States Patent
Kurashina

(10) Patent No.: US 6,276,851 B1
(45) Date of Patent: Aug. 21, 2001

(54) TAPE PRINTING APPARATUS AND TAPE LENGTH-SETTING METHOD

(75) Inventor: Hiroyasu Kurashina, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/633,225

(22) Filed: Aug. 7, 2000

(30) Foreign Application Priority Data

Aug. 10, 1999 (JP) ..... 11-226478

(51) Int. Cl.[7] ..... B41J 11/26; B41J 11/44; B41J 5/30; B41J 9/44

(52) U.S. Cl. ..... 400/615.2; 400/76; 400/70; 400/61

(58) Field of Search ..... 400/615.2, 76, 400/70, 61

(56) References Cited

U.S. PATENT DOCUMENTS 5,222,818 * 6/1993 Akiyama et al. ..... 400/61
5,584,591 * 12/1996 Mori et al. ..... 400/615.2
5,885,016 * 3/1999 Toyosawa et al. ..... 400/621

FOREIGN PATENT DOCUMENTS 5-305748 11/1993 (JP) .
7-156477 6/1995 (JP) .
10-181160 7/1998 (JP) .
11078129 * 3/1999 (JP) .

* cited by examiner

*Primary Examiner*—John S. Hilten
*Assistant Examiner*—Charles H. Nolan, Jr.
(74) *Attorney, Agent, or Firm*—Hogan & Hartson, LLP

(57) ABSTRACT

There are provided a tape printing apparatus and a tape length-setting method which permits the user to set a desired tape length quickly and reliably, without requiring troublesome operations before printing. The tape printing apparatus is capable of printing a character string on a tape as a medium to be printed upon over a desired tape length. A character string including at least one character is input via a keyboard. A minimum tape length is calculated over which the input character string can be printed, before a print command is generated. A plurality of candidate tape lengths are displayed over which the input character string can be printed, dependent on the minimum tape length. A tape length is selected from the plurality of candidate tape lengths displayed. The input character string is printed over the selected tape length in response to the print command.

12 Claims, 9 Drawing Sheets

F I G. 9

| TAPE LENGTH | INCREMENT |
|---|---|
| 1cm TO 2cm | 0.1cm |
| 2cm TO 4cm | 0.2cm |
| 4cm TO 10cm | 0.5cm |
| 10cm TO 20cm | 1cm |
| 20cm TO 40cm | 2cm |
| 40cm TO 95cm | 5cm |

F I G. 1 0

| LENGTH | OPTION |
|---|---|
| 7cm | MD, 3.5FD |
| 9.5cm | MUSIC TAPE |
| 14cm | VHS / β |
| 15cm | B5 FILE |
| 20cm | A4 FILE |

TAPE PRINTING APPARATUS AND TAPE LENGTH-SETTING METHOD

BACKGROUND OF THE INVENTION

1. Field of the Invention

This invention relates to a tape printing apparatus and a tape length-setting method which are capable of setting a tape length rapidly and reliably when printing is carried out.

2. Prior Art

Recently, there have been proposed tape printing apparatuses that carry out so-called "fixed length printing", in which the length of a tape printed with an arbitrary character string can be set to a desired tape length such that the tape can be affixed to a predetermined affixing area in a manner adapted thereto. In these tape printing apparatuses, to form a tape having a desired tape length, first, settings of a format, such as a desired tape length, character sizes, lengths between the characters, lengths of the front and rear margins of the tape, are set to the arbitrary character string entered. Then, when a predetermined key (hereinafter referred to as the "print key") for instructing a printing operation is depressed, if the arbitrary character string entered can be printed over the desired tape length, the printing operation is executed, whereas if the character string cannot be printed thereover, an error warning is generated.

In the above tape printing apparatus, however, the user is not notified of the fact that the character string cannot be printed on the tape length set or determined, until he depresses the print key to have an error warning issued, so that he cannot know whether or not printing can be carried out over a tape length at a time point of setting the same. Consequently, when the user depresses the print key to find that it is impossible to execute printing over the tape length he set, the user is required to edit the character string again to adapt it to the tape length or set the tape length again such that it is made longer than the value he set the last time. Further, the user has to depress the print key again to determine whether or not printing can be carried out. This makes the user feel that it is troublesome to operate the apparatus.

SUMMARY OF THE INVENTION

It is an object of the invention to provide a tape printing apparatus and a tape length-setting method which permits the user to set a desired tape length quickly and reliably, without requiring troublesome operations before printing.

To attain the above object, according to a first aspect of the invention, there is provided a tape printing apparatus that is capable of printing a character string on a tape as a medium to be printed upon over a desired tape length.

The tape printing apparatus according to the first aspect of the invention is characterized by comprising:

- input means for inputting a character string including at least one character;
- tape length calculation means for calculating a minimum tape length over which the input character string can be printed, before a print command is generated;
- candidate tape length display means for displaying a plurality of candidate tape lengths over which the input character string can be printed, dependent on the minimum tape length;
- tape length selection means for selecting a tape length from the plurality of candidate tape lengths displayed; and

- printing means for printing the input character string over the selected tape length in response to the print command.

According to this tape printing apparatus, based on a character string comprised of at least one character entered by the entry means, the minimum tape length over which the entered character string can be printed is calculated by the tape length calculation means, and with reference to the calculated minimum tape length, a plurality of candidate tape lengths over which the input character string can be printed are displayed by the candidate tape length display means. Then, a desired tape length is selected from the plurality of displayed candidate tape lengths by the tape length selection means, and by setting the selected tape length, it becomes possible to print the character string. Therefore, a tape length over which the input character string cannot be printed (i.e. smaller in value than the minimum tape length) is prevented from being displayed as a candidate, and only tape lengths over which the input character string can be printed are displayed. Therefore, it is possible to prevent a wrong tape length from being erroneously selected. In short, according to the tape printing apparatus, it is possible to set a desired tape length quickly and reliably, without requiring troublesome operations before printing.

It should be noted that throughout the specification the term "characters" are used to mean characters, including letters, symbols, and images, which are normally input to the apparatus.

Preferably, the plurality of candidate tape lengths include a preferential candidate displayed preferentially to other candidates in respect of at least one of a mode of display, a position, and an order of display.

According to this preferred embodiment, the plurality of candidate tape lengths include a preferential candidate displayed preferentially to other candidates in respect of at least one of the mode of display, the position, and the order of display, so that it is possible to save the trouble of searching for a predetermined option (preferential candidate) from the menu of options (candidates), thereby permitting the predetermined option to be more quickly selected.

More preferably, when the plurality of candidate tape lengths includes a tape length selected last time, the preferential candidate is the tape length selected last time.

According to this preferred embodiment, when the plurality of candidate tape lengths include a tape length selected the last time (assuming that a character string input this time can be printed by using the tape length selected last time), the "tape length selected last time" is preferentially displayed as the preferential candidate. This makes it possible to lighten the trouble of selecting a tape length when strips of tape having a predetermined length are continually made.

Alternatively or in combination, the plurality of candidate tape lengths include the minimum tape length, and the preferential candidate is the minimum tape length.

According to this preferred embodiment, since the minimum tape length is preferentially displayed as a candidate tape length, it is possible to lighten the trouble of selecting a tape length, e.g. when the tape length is desired to be made as short as possible to reduce consumption of the tape.

Preferably, the plurality of candidate tape lengths include a candidate tape length represented by an extra length which is a difference between a whole tape length of the candidate tape length and the minimum tape length.

According to this preferred embodiment, the plurality of candidate tape lengths include a candidate tape length represented by an extra length (obtained by adding up lengths of the front and rear margins of the tape and lengths of spaces between characters on the tape) which is the difference between the whole tape length of a candidate and the minimum tape length. This makes it easy to select a tape length, when the user desires to attach more importance to the lengths of the front and rear margins and the lengths of spaces between characters than to the tape length, for instance.

More preferably, the plurality of candidate tape lengths include a plurality of candidates each represented by a combination of any two of a sum of the minimum tape length and the extra length, the minimum tape length, and the extra length.

According to this preferred embodiment, the plurality of candidates each include any two of the "sum of the minimum tape length and the extra length", the "minimum tape length", and the "extra length" (assuming that the minimum tape length is 3 cm, and the extra length is 1 cm, they are displayed as follows: "MINIMUM TAPE LENGTH 3 cm+EXTRA LENGTH 1 cm" or "TAPE LENGTH 4 cm (including EXTRA LENGTH 1 cm)" or the like). Accordingly, for instance, when the user desires to set a tape length by taking into account not only the tape length but also the extra length, he can select the tape length with ease.

Preferably, the plurality of candidate tape lengths include a plurality of candidates expressed not by respective specific numerical values but by respective representations of predetermined lengths of areas of articles to which the tape printed with the character string is to be affixed.

According to this preferred embodiment, the plurality of candidate tape lengths include a plurality of candidates expressed not by specific numerical values but by representations of articles to which the tape printed with the character string is to be affixed (e.g. an pictographic character illustrating an MD which represents a predetermined length 7 cm of an area of the MD to which the tape is to be affixed, assuming that an article to which the tape printed with the character string is to be affixed is the MD). This makes it easy to select the tape length when an article is definite to which the tape printed with the character string is to be affixed.

Preferably, the plurality of candidate tape lengths include a plurality of candidates whose tape lengths relative to the minimum tape length are expressed not by specific numerical values but by intuitively understandable expressions of the tape lengths, respectively.

According to this preferred embodiment, the plurality of candidate tape lengths include a plurality of candidates whose tape lengths relative to the minimum tape length are expressed not by specific numerical values but by intuitively understandable expressions ("LONGER", "NORMAL", "SHORTER", etc.) of the tape lengths. This makes it easy to carry out setting operations. For instance, when the user desires to provide suitable room for the lengths of the front and rear margins of the tape, he can select "NORMAL" without setting specific numerical values.

Preferably, the tape length selection means is permitted to select the tape length from the plurality of candidate tape lengths after the print command has been generated.

According to this preferred embodiment, after the print command has been generated, a desired tape length can be selected, so that it is possible to prevent generation of an error warning when the printing is instructed. Further, there is no need to repeatedly carry out operations e.g. for changing settings and instructing a new printing operation whenever an error warning is generated.

Preferably, the candidate tape length display means displays the plurality of candidate tape lengths after the print command is generated.

According to this preferred embodiment, since the plurality of candidate tape lengths are not displayed until a predetermined print command is issued, the candidate tape lengths are not displayed on text edit screens, whereby the screens can be used efficiently.

Preferably, the tape printing apparatus further includes print position selection means for selecting any one of forward alignment, center alignment, backward alignment, and justify, except when the tape length selected by the tape length selection means is the minimum tape length.

According to this preferred embodiment, except when the minimum tape length is selected as the tape length, the position of a character string on the tape can be selected from the options of "forwardalignment", "center alignment", "backward alignment", and "justify". This makes it possible to form a tape further fulfilling the user's needs.

To attain the above object, according to a second aspect of the invention, there is provided a method of setting a tape length, comprising the steps of:

calculating a minimum tape length over which an input character string including at least one character can be printed;

displaying a plurality of candidate tape lengths over which the input character string can be printed, dependent on the minimum tape length; and selecting a tape length from the plurality of candidate tape lengths displayed to set the selected tape length.

According to this tape length-setting method, based on a character string including at least one character entered, a minimum tape length over which the entered character string can be printed is calculated, and with reference to the minimum tape length, a plurality of candidate tape lengths larger than the minimum tape length over which the entered character string can be printed are displayed. Therefore, a tape length over which the input character string cannot be printed is prevented from being displayed. This makes it possible to reliably and quickly set a desired tape length.

The above and other objects, features, and advantages of the invention will become more apparent from the following detailed description taken in conjunction with the accompanying drawings.

BRIEF DESCRIPTION OF THE DRAWINGS

FIG. 9 is a table showing the relationship between ranges of fixed values of tape lengths for designation and increments; and FIG. 10 is a table showing examples of menu options displayed to indicate respective candidates tape lengths.

DETAILED DESCRIPTION

Figure 1:
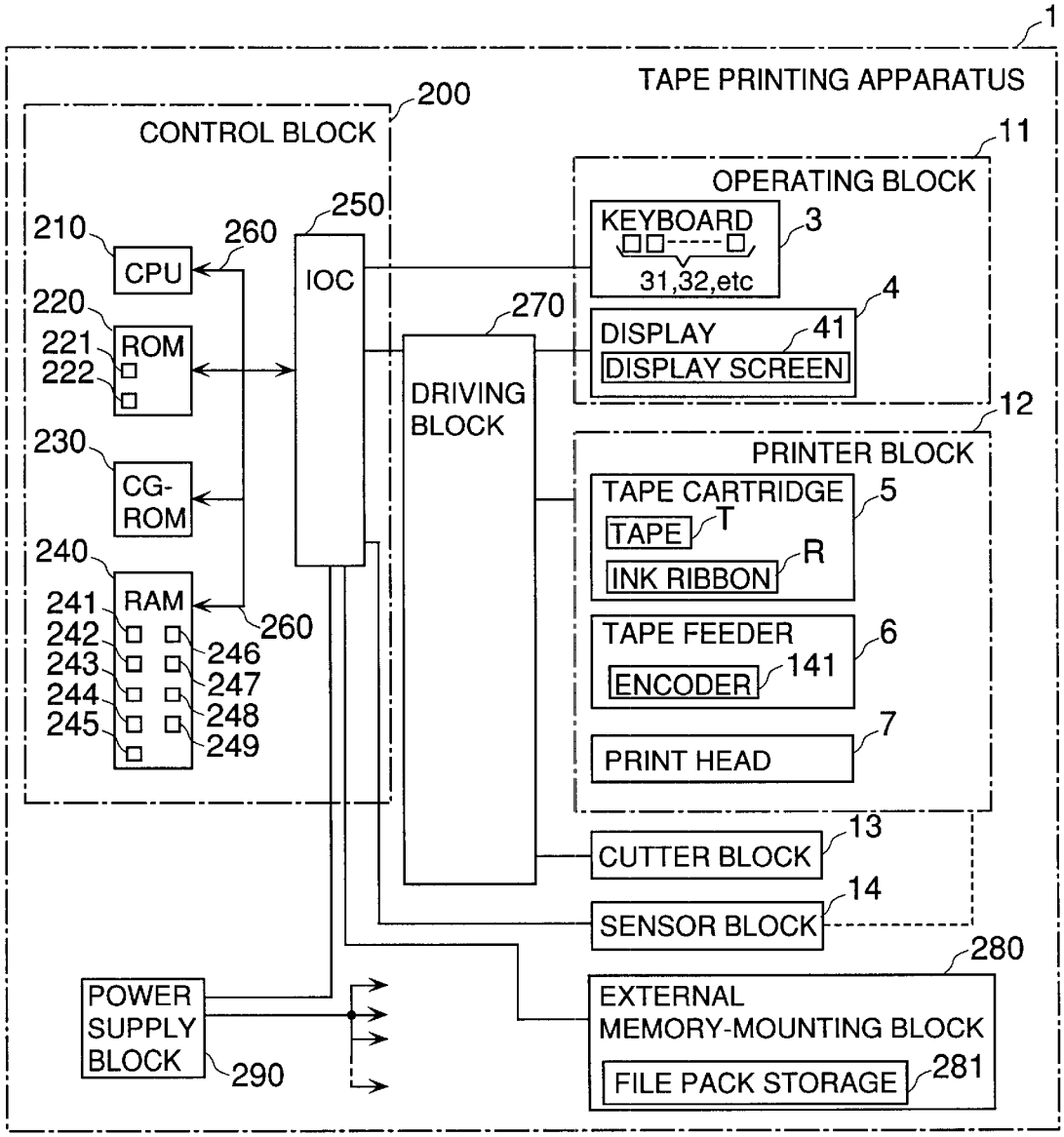
FIG. 1 is a block diagram showing the arrangement of a control system of a tape printing apparatus according to an embodiment of the invention.

Next, a tape printing apparatus and a tape length-setting method according to an embodiment of the invention will be described in detail with reference to the drawings. FIG. 1 is a block diagram of a control system of the tape printing apparatus.

The tape printing apparatus 1 is capable of carrying out color printing of a print image on a tape T by a thermal printing method as well as cutting off the printed portion of the tape T to thereby produce a label. The print image is formed based on desired letters and the like entered via a keyboard of the apparatus 1.

The tape T is comprised of a substrate tape, an adhesive layer coated on an underside surface of the substrate tape, and a release paper tape affixed to the adhesive layer. The substrate tape is formed of a material which is capable of readily absorbing ink, such as paper, paper with a coated layer or a film with a coated layer. The adhesive layer is used for affixing a printing tape as a label to an object article, such as a file, while the release paper tape is used for preventing dust or dirt from depositing on the adhesive layer. Tape cartridges are provided which contain various kinds of tapes T with various tape widths of 4.5 mm to 48 mm. A print image having a resolution of 24 to 1024 dots in the direction of the width of the tape is printed on the tape T, dependent on the width thereof. It should be noted that there are provided still other tapes T different in material or having background colors other than white. Therefore, it is possible to use at least several tens of kinds of tapes T including ones to be adopted in the future.

As shown in FIG. 1, the tape printing apparatus 1 is basically comprised of an operating block 11 which includes the keyboard 3 and a display 4 and provides interface between the apparatus land the user, a printer block 12 which includes a tape cartridge 5 removably mounted in the apparatus 1, a print head 7 of a thermal type, and a tape feeder 6, referred to hereinafter, and prints on a tape T fed from the tape cartridge 5, by the print head 7, a cutter block 13 for cutting off the printed portion of the tape T, a sensor block 14 having various sensors for carrying out various detecting operations, a driving block 270 having various drivers for driving circuits of blocks and devices, an external memory-mounting block 280 for removably mounting an external memory 281 (called "file pack storage") therein, a power supply block 290, and a control block 200 for controlling operations of components of the tape printing apparatus 1 including the above-mentioned sensors and drivers. To implement the above construction, a casing of the apparatus accommodates a circuit board, not shown, in addition to the printer block 12, the cutter block 13, the sensor block 14, the external memory-mounting block 280, and so forth. On the circuit board are mounted the power supply block 290 and the circuits of the driving block 270 and the control block 200. A power supply unit of the power supply block 290 is connected to a connector socket 24 connectable with an AC adapter, and a battery, such as a nicad battery, removably mounted from the outside of the apparatus casing, so as to supply power to the components of the tape printing apparatus 1.

Although illustration and indication of each component are omitted, the printer block 12 has the tape cartridge 5 containing the tape T and an ink ribbon R within a cartridge casing. The tape cartridge 5 has a through hole for receiving therein a head unit arranged in a compartment of the printer block. The tape cartridge 5 contains a tape reel for receiving therein a positioning pin arranged in the compartment, and a ribbon take-up reel for receiving therein a ribbon take-up reel-driving shaft arranged in the compartment. Further, a platen roller for receiving therein a platen drive shaft arranged in the compartment is arranged within the tape cartridge at a location where the tape T and the ink ribbon R overlap, and which corresponds to the print head (thermal head) 7 incorporated in the head unit.

The tape cartridge 5 has a plurality of small holes formed in the bottom thereof for discrimination of the type of tape T contained therein from the other types of the tape T having different widths, which are contained in other tape cartridges 5. A tape-discriminating sensor, not shown, comprised e.g. of micro-switches is arranged in the compartment, for detecting these holes to thereby determine the type of tape T contained in the tape cartridge. Further, the compartment is provided with an ambient temperature sensor, such as a thermistor, which sends information of an ambient temperature detected thereby to the control block 200. Further, a head surface temperature sensor formed e.g. by a thermistor, is arranged on a surface of the print head 7 in a manner intimately contacting the surface, which sends information of the surface temperature of the thermal head 7 detected thereby to the control block 200. The apparatus casing is formed with a tape exit which communicates between the compartment and the outside of the apparatus. On the tape exit faces a tape cutter for cutting off a dispensed portion of the tape T.

When the tape cartridge 5 is mounted in the compartment, the through hole of the tape cartridge 5 receives therein the head unit, the tape reel receives therein the positioning pin, the platen roller receives therein the platen drive shaft, and the ribbon take-up reel receives therein the ribbon take-up reel drive shaft, which enables the feed of the tape T and the ink ribbon R. Further, in the above state, the print head 7 is brought into contact with the platen roller in a manner sandwiching the tape T and the ink ribbon R therebetween, whereby the apparatus is ready for a printing operation. When the tape T is rolled out from the tape reel, the ink ribbon R is also rolled out from the ribbon reel and fed or run together with the tape T in a state lying upon the tape T, followed by being taken up by the ribbon take-up reel. That is, the platen roller and the ribbon take-up reel are rotated in synchronism with each other, whereby the tape T and the ink ribbon 18 are simultaneously fed, and at the same time the print head 7 is driven in synchronism with running of the tape T and the ink ribbon R to thereby carry out printing.

In the tape printing apparatus 1, the user, after mounting the tape cartridge 5 in the compartment of the printer block 12, enters printing information of print images, such as desired characters (letters, numerals, symbols, figures and the like), via the keyboard 3, and at the same time confirms or views results of the entry on the display 4 for editing the same. Thereafter, when the user instructs a printing operation via the keyboard 3, the tape feeder 6 of the printer block 12 is driven to unwind the tape T from the tape cartridge 5, and at the same time the print head 7 is driven to print characters on the tape T as desired. The printed portion of the tape T is delivered from the tape exit, as the printing operation proceeds. After the desired characters have been printed in the above manner, the platen roller continues to rotate for a predetermined time period (the ribbon take-up reel also continues to rotate in synchronism with rotation of the platen roller), whereby the tape T continues to be fed until a predetermined cutting position on the tape T, which is adapted to a tape length including the length of a marginal area, reaches a point corresponding to a location of the tape cutter.

The tape feeder 6 of the printer block 12 is arranged in a space extending from a lateral side of the compartment to a bottom side of the same, and rotates the platen drive shaft and the ribbon take-up reel drive shaft by using a tape feed motor (TF motor) arranged as a power (drive) source at a location laterally outward of the compartment. The tape feeder 6 includes the TF motor, the platen drive shaft, the ribbon take-up reel drive shaft, a reduction gear train for transmitting part of the driving force of the TF motor to each of the drive shafts, and a chassis for supporting them thereon.

Further, the TF motor according to the present embodiment is implemented by a DC motor, and the tape feeder 6 of the printer block 12 further includes an encoder 141 for detecting the number of rotations of the TF motor (DC motor). The encoder 141 is comprised of a disc, not shown, which is formed with four detection openings along a periphery thereof and rigidly fixed to an end of the main shaft of the DC motor, and a rotational speed sensor, not shown, which is comprised of a photo sensor which faces the detection openings of the disk, and a sensor circuit board supporting the photo sensor thereon and carries out photoelectric conversion in cooperation with the photo sensor. The photo sensor has a light-emitting element and a light-receiving element arranged in a manner opposed to each other. Light emitted from the light-emitting element passes through the detection openings (arranged along the periphery) of the disk and is received by the light-receiving element whereby the number of rotations of the DC motor is detected (the number of pulses corresponding to the number of turns of the DC motor is generated). In other words, the on-off of the light received from the light-emitting element by the light-receiving element is photoelectrically converted by the sensor circuit board and output as a pulse signal to the control block 200. Of course, the above TF motor can also be constructed by a stepping motor (pulse motor) to omit the encoder 141 such that the tape T can be fed with ease by a predetermined number of steps based on the pulse signal.

In FIG. 1, for convenience of description, it is assumed that the sensor block 14 includes the tape-discriminating sensor, the ambient temperature sensor, the head surface temperature sensor, and the rotational speed sensor, described hereinabove. The sensor block 14 generates signals indicative of the sensed type of a tape, ambient temperature, head surface temperature, and rotational speed. These signals are reported or delivered to the control block 200. It should be noted that in the sensor block 14 can be provided other sensors, such as a voltage sensor which is connected to the power supply unit of the power supply block 290 that supplies power to the components of the tape printing apparatus 1, for detecting changes in the electric potential of the power supply unit, and the like, or some of the above sensors, such as the encoder 141 in the case of the TF motor being the pulse motor, can be omitted to suit the actual requirements of the apparatus.

Next, the cutter block 13 includes a tape cutter and a cutter motor for driving the tape cutter for cutting operations. When the tape T is cut automatically, the tape T is further sent by the length of a rear margin after completion of the printing operation, and then stopped, whereupon the cutter motor is driven to cut off the tape T. It should be noted that the tape printing apparatus 1 is provided with a cut key for enabling the user to manually cut the tape by key stroke, and it is possible to switch between an automatic cutting mode and a manual cutting mode. In the manual cutting mode, when the printing operation and additional feed of the tape are completed, the user depresses the cut key, whereby the tape cutter is actuated to cut off the tape T into a desired length.

The driving block 270 includes a display driver, a head driver, and a motor driver. The display driver drives the display 4 of the operating block 11 in response to control signals delivered from the control block 200, i.e. in accordance with commands carried by the signals. Similarly, the head driver drives the print head 7 of the printer block 12 in accordance with commands from the control block 200. Further, the motor driver has a TF motor driver for driving the TF motor of the printer block 12, and a cutter motor driver for driving the cutter motor of the cutter block 13, and drives each motor in accordance with commands from the control block 200.

Next, according to the tape printing apparatus 1, the user can removably mount the external memory (hereinafter referred to as the "file pack storage") 281 which is capable of storing data of a lot of document files and the like, as an auxiliary memory for use with a RAM 240, described hereinafter. The file pack storage 281 contains one or a plurality of (e.g. two) SRAMs (static RAMs), and is backed-up by batteries or the like, such that stored data can be preserved even when the file pack storage 281 is removed from the tape printing apparatus 1. Further, when the file pack storage 281 is mounted in a compartment of the external memory-mounting block 280, the file pack storage works such that it appears to the user to be part (e.g. one directory) of a memory area of the RAM 240, and is employed as a work area for carrying out control operations.

The operating block 11 includes the keyboard 3 and the display 4. The display 4 has a display screen 41 which is capable of displaying display image data e.g. of 198×64 dots on a rectangular display area of approximately 8 cm in the horizontal direction (X direction)×4 cm in the vertical direction (Y direction). The display 4 is used by the user when he enters data via the keyboard 3 to form or edit matrix data representative of a character string image having characters, such as letters, numerals, symbols, simple figures, etc., (hereinafter generically referred to as "characters") arranged therein and a print image including the character string image, view the resulting data, and enter various commands including ones for selection via the keyboard 3.

On the keyboard 3, there are arranged a character key group 31 including an alphabet key group, not shown, a symbol key group (including a space key), not shown, a number key group, not shown, and a nonstandard character key group, not shown, for calling nonstandard characters for selection, as well as a function key group 32 for designating various operation modes. In a type of the apparatus 1 which is capable of entering the Japanese language, there is also provided a kana key group, not shown, for entering Japanese hiragana letters and Japanese katakana letters.

The function key group 32 includes a power key, not shown, a print key, not shown, for instructing a printing operation, a selection key, not shown, for finally determining entry of character data and starting new lines during text entry as well as determining selection of one of the various operating modes on a corresponding one of the selection screens, a color specification key, not shown, for specifying printing colors including neutral colors (mixed colors) of print image data, a color-setting key, not shown, for setting colors of characters and background colors, and four cursor keys (up arrow key, down arrow key, left arrow key, and right arrow key), not shown, for moving the cursor or the display range of print image data on the display screen 41 in respective upward, downward, leftward, and rightward directions.

The function key group 32 also includes a cancel key, not shown, for canceling instructions, a shift key, not shown, for use in changing roles of respective keys as well as modifying registered image data, an image key, not shown, for alternately switching between a text entry screen or a selection screen and a display screen (image screen) for displaying print image data, a proportion-changing (zoom) key, not shown, for changing a proportion between the size of print image data and the size of display image data displayed on the image screen, a style key, not shown, for setting styles of labels to be formed, a file key, not shown, for handling files, an illustration key, not shown, for selecting background images, the cut key, not shown, for manually cutting the tape T, a nonstandard character key, not shown, for registering nonstandard characters, a conversion key, not shown, for carrying out conversion operations, such as kana-kanji conversion (in the case of a Japanese language-adapted type of the apparatus), a pack key, not shown, for initialization of the file pack storage 281 or changing the settings thereof, a format key, not shown, for setting a format for printing background patterns, a special print key, not shown, for setting a special print format for carrying out continuous printing, enlarged printing, mirrored character printing, and the like.

Similarly to keyboards of the general type, the above key entries may be made by separate keys exclusively provided for respective key entries and/or by a smaller number of keys operated in combination with the shift key or the like. Here, for purposes of ease of understanding, the following description will be made assuming that there are provided as many keys as described above.

As shown in FIG. 1, from the keyboard 3, various commands and data described above are input to the control block 200.

The control block 200 includes a CPU 210, a ROM 220, a character generator ROM (CG-ROM) 230, a RAM 240, and an input/output control circuit (IOC) 250, all of which are connected to each other by an internal bus 260.

The ROM 220 has a control program area 221 storing control programs executed by the CPU 210 as well as a control data area 222 storing control data including a color conversion table, a character modification table, and the like. The CG-ROM 230 stores font data, i.e. data defining characters, symbols, figures and the like, provided for the tape printing apparatus 1. When code data identifying a character or the like is input thereto, it outputs the corresponding font data. In the type of the apparatus 1 which is capable of handling the Japanese language, the control data area 222 also stores a kana-kanji conversion table for converting Japanese hiragana letters into corresponding Japanese kanji letters.

The RAM 240 is backed-up such that stored data items can be preserved even when the power is turned off by operating the power key. The RAM 240 includes areas of a register group 241 for storing values of flags, etc., a text data area 242 for storing text data of characters or the like entered by the user via the keyboard 3, a display image data area 243 for storing image data displayed on the display screen 41, a print image data area 244 for storing print image data, a registered image data area 245 for storing registered image data, a nonstandard character registration image data area 246 for storing nonstandard character registration image data, a background image data area 247 for storing background image data as candidates for background images and character color data corresponding thereto, and buffer areas 248 including a character image-forming buffer, a color conversion buffer, color-by-color dithered image matrix-arranging buffers, a print buffer, and so forth. The RAM 240 is used as a work area for carrying out the control operations.

The IOC 250 incorporates a logic circuit for complementing the functions of the CPU 210 as well as dealing with interface signals for interfacing between the CPU 210 and peripheral circuits. The logic circuit is comprised of gate arrays, and custom LSI's. The IOC 250 also incorporates the function of a timer for measuring elapsed time. The IOC 250 is connected to the sensors of the sensor block 14 and the keyboard 3, for receiving the signals generated by the sensor block 14 as well as commands and data entered via the keyboard 3, and inputting these to the internal bus 260 directly or after processing them. Further, the IOC 250 cooperates with the CPU 210 to deliver data and control signals input to the internal bus 260 by the CPU 210 or the like, to the driving block 270 directly or after processing them.

Further, the IOC 250 is connected to the external memory-mounting block 280 to control the input and output of data apparently carried out by accessing the RAM 240 but actually carried out by accessing the file pack storage 281, whereby when the file pack storage 281 is mounted in the compartment of the external memory-mounting block 280, the IOC 250 carries out control operations such that the RAM 240 appears to be expanded (the memory capacity of the RAM 240 appears to be increased) to the user (in handling files and the like). Therefore, in the following, unless otherwise specified, description is made assuming that the RAM 240 includes a memory capacity of the file pack storage 281, and that data stored in the file pack storage 281 is stored in the RAM 240 (although shown as the file pack storage area 281 in FIG. 1 for purposes of clarity, actually, part or all of each of the above areas can be shared with the file pack storage 281).

The CPU 210 of the control block 200 receives the signals and data from the components of the tape printing apparatus 1 via the IOC 250, according to the control program read from the ROM 220, processes font data from the CG-ROM 230 and various data stored in the RAM 240 (including the file pack storage 281, as described above), and delivers signals and data to the components of the tape printing apparatus 1 via the IOC 250 to thereby carry out position control during printing operations, display control of the display screen 41, and print control that causes the print head 7 to carry out printing on the tape T under predetermined printing conditions. In short, the CPU 210 controls the overall operation of the tape printing apparatus 1.

Figure 2:
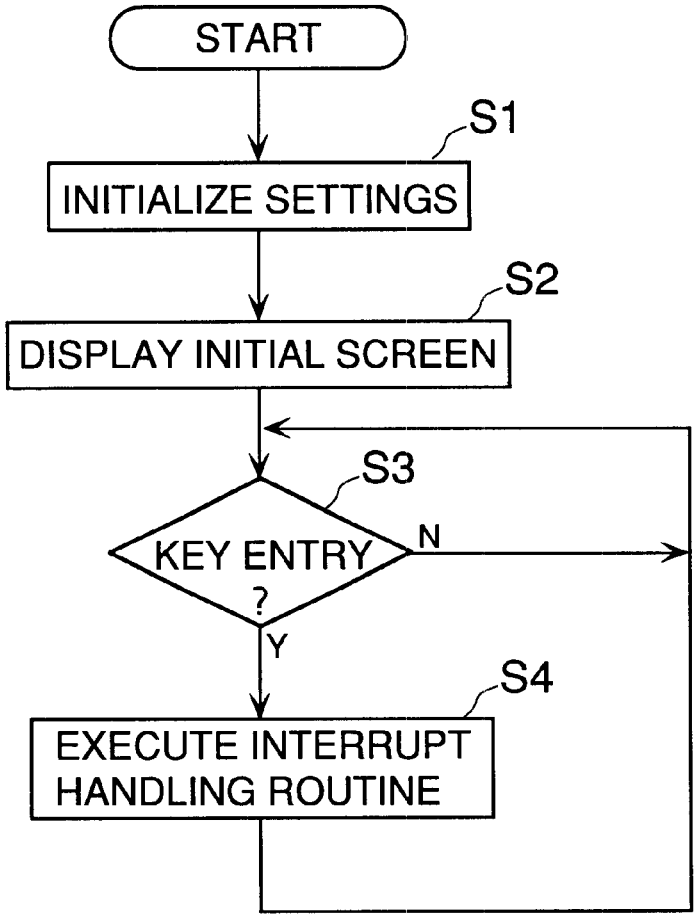
FIG. 2 is a flowchart showing a conceptual representation of an overall control process executed by the FIG. 1 tape printing apparatus.

Next, the overall control process carried out by the tape printing apparatus 1 will be described with reference to FIG. 2. As shown in the figure, when the program for carrying out the control process is started e.g. when the power key is depressed (the power of the tape printing apparatus 1 is turned on), first, at step S1, initialization of the system including restoration of saved control flags is carried out to restore the tape printing apparatus 1 to the state it was in before the power was turned off the last time. Then, the image that was displayed on the display screen 41 before the power was turned off the last time is shown as an initial screen at step S2. The following steps in FIG. 2, that is, step S3 for determining whether or not a key entry has been made and step S4 for carrying out an interrupt handling routine are conceptual representations of actual operations. Actually, when the initial screen has been displayed at step S2, the tape printing apparatus 1 enables an interrupt by key entry (keyboard interrupt), and maintains the key entry wait state (No to S3) until a keyboard interrupt is generated. When the keyboard interrupt is generated (Yes to S3), a corresponding interrupt handling routine is executed at step S4, and after the interrupt handling routine is terminated, the key entry wait state is again enabled and maintained (No to S3).

As described above, in the tape printing apparatus 1, main processing operations by the apparatus are carried out by interrupt handling routines, and hence if print image data for printing is provided or has been prepared, the user can print a print image based on the print image data at a desired time point, by depressing the print key to thereby generate an interrupt by the print key and start a printing process. In short, an operating procedure before the printing operation can be selected by the user as he desires.

In a narrow sense, the terms "display image" and "print image" mean a displayed image itself and a printed image itself, respectively, and the apparatus ideals with display image data representative of a display image and print image data representative of a print image. That is, although in the apparatus 1, an object to be subjected to image forming/modification/registration is image data but not an image itself, for simplicity of the following description, similarly to the case of referring to an image itself represented by the image data, "image data representing ?? image" is referred to as an "?? image".

The tape printing apparatus and the tape length-setting method according to the invention are implemented mainly by the control block 200, the operating block 11, and the printer block 12. Now, features of operations executed by the apparatus 1, more particularly "fixed length printing" executed thereby will be described with reference to FIGS. 3 to 10. It should be noted that the "fixed length printing" according to the invention is carried out by setting the whole length of a tape (strip of tape) including the front and rear margins thereof, and a print position within the range of the tape length.

Figure 3:
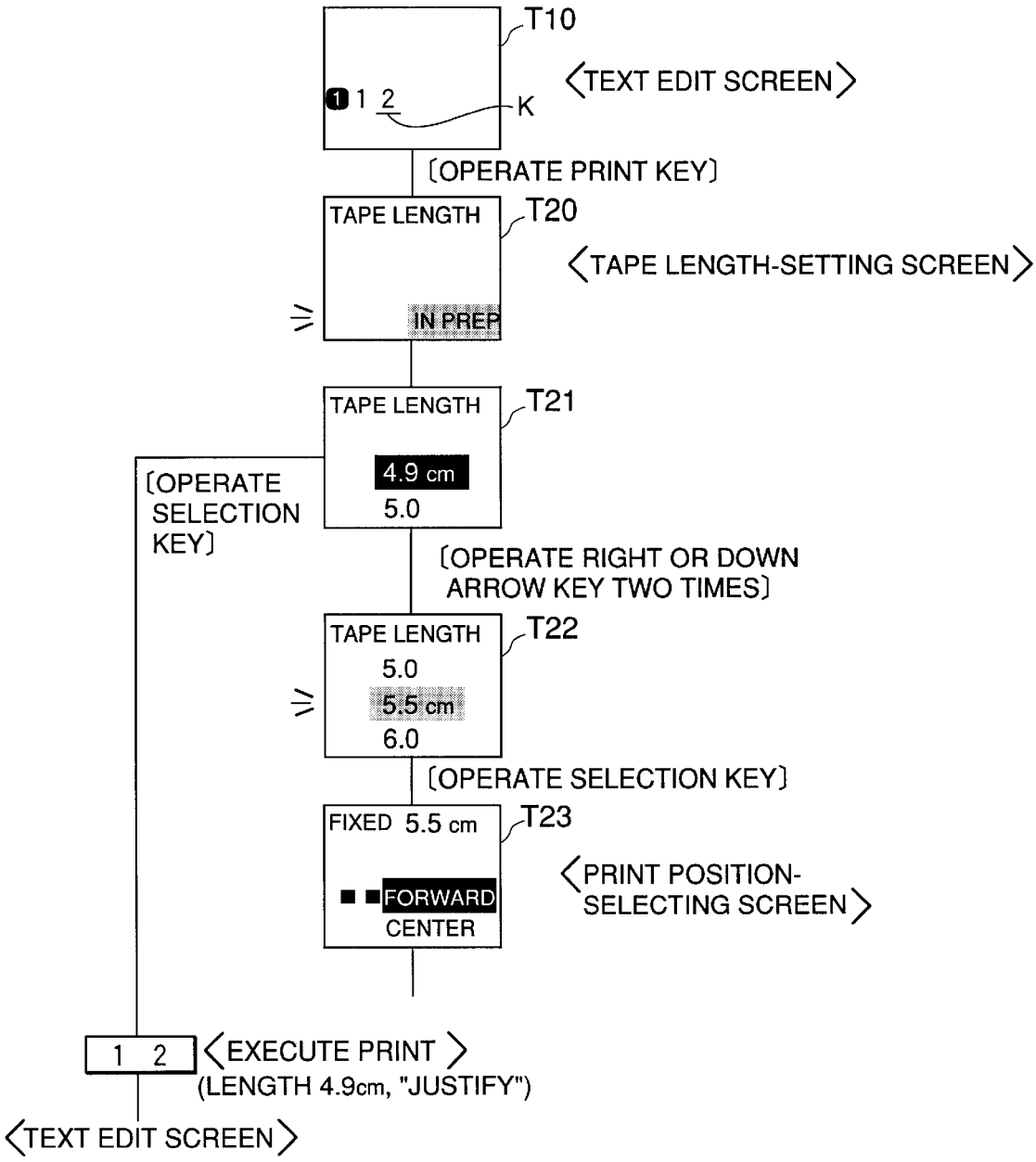
FIG. 3 is a diagram showing an example of a sequence of screens displayed during a process for setting normal fixed length printing, which is useful in explaining a typical operating procedure for execution of the process.

First, as shown in FIG. 3, if the print key is depressed (operated) by the user when a text edit screen displays a character string "12" entered by the user (screen T10: hereinafter, contents displayed on the display screen 41 of the display 4 are referred to as the "screen T??" (? represents a digit) and the reference numerals for the screens are shown only by T??, with a cursor position being indicated by a symbol K), the screen is switched to a tape length-setting screen which displays a character string "TAPE LENGTH" in a heading area at the top of the screen. At the same time, a minimum value (hereinafter referred to as the "value S") of a fixed length is calculated, over which the character string "12" entered by the user can be printed. In the meanwhile, a message "IN PREP" blinks (T20). The "value S" is obtained by calculating a print length, based on a character size, a length between characters, lengths of front and rear margins, information of character modification or decoration, and so forth, and then a rounding off a value of the print length in the second decimal place (in units of cm) to represent the same in centimeter to one decimal place. After calculation of the "value S", if this is the first time to print the entered character string, the "value S" ("4.9 cm, in the illustrated example) is highlighted as a default (T21). Further, if this is a second or later time to print the same, a value set last time is highlighted as a default (see T40 in FIG. 5).

To carry out the printing by using the "value S", the selection key is depressed in the state of T21, whereby the character string "12" is printed over the tape length of the "value S" ("4.9 cm", in the illustrated example). It should be noted that since a print position (selected from options of "FORWARD" (forward alignment), "CENTER" (center alignment), "BACKWARD" (backward alignment), and "JUSTIFY") is set to "JUSTIFY" as a default, the printing is carried out with the print position set to "JUSTIFY". The screen returns to the text edit screen (T10) upon completion of the printing.

Next, if the character string "12" is not printed by using the "value S", first, a desired tape length is selected by the user from a plurality of candidate tape lengths displayed on the screen T21. The candidate tape lengths displayed are fixed values equal to or larger than the "value S", and an incremental value from one fixed value to another is shown in FIG. 9. A desired one of the candidate tape lengths can be selected by operating the cursor key 330. To select a larger value displayed at a lower position, the right arrow key or the down arrow key is operated, whereas to select a smaller value displayed at an upper position, the left arrow key or the up arrow key is operated. If a tape length desired by the user is "5.5 cm", the right arrow key or the down arrow key is depressed two times from the state (T21) of the option or candidate "4.9 cm" being highlighted for selection (if one of the keys is depressed once, an option or candidate "5.0 cm" is displayed in a shaded manner, and if it is depressed once more, an option or candidate "5.5 cm" is displayed in a shaded manner (T22)). The unit of length "cm" is displayed only on a line where the cursor is positioned. Subsequently, if the selection key is depressed, the screen is switched to a print position-selecting screen which displays "FIXED 5.5 cm" in the heading area at the tope of the screen (T23).

Figure 4:
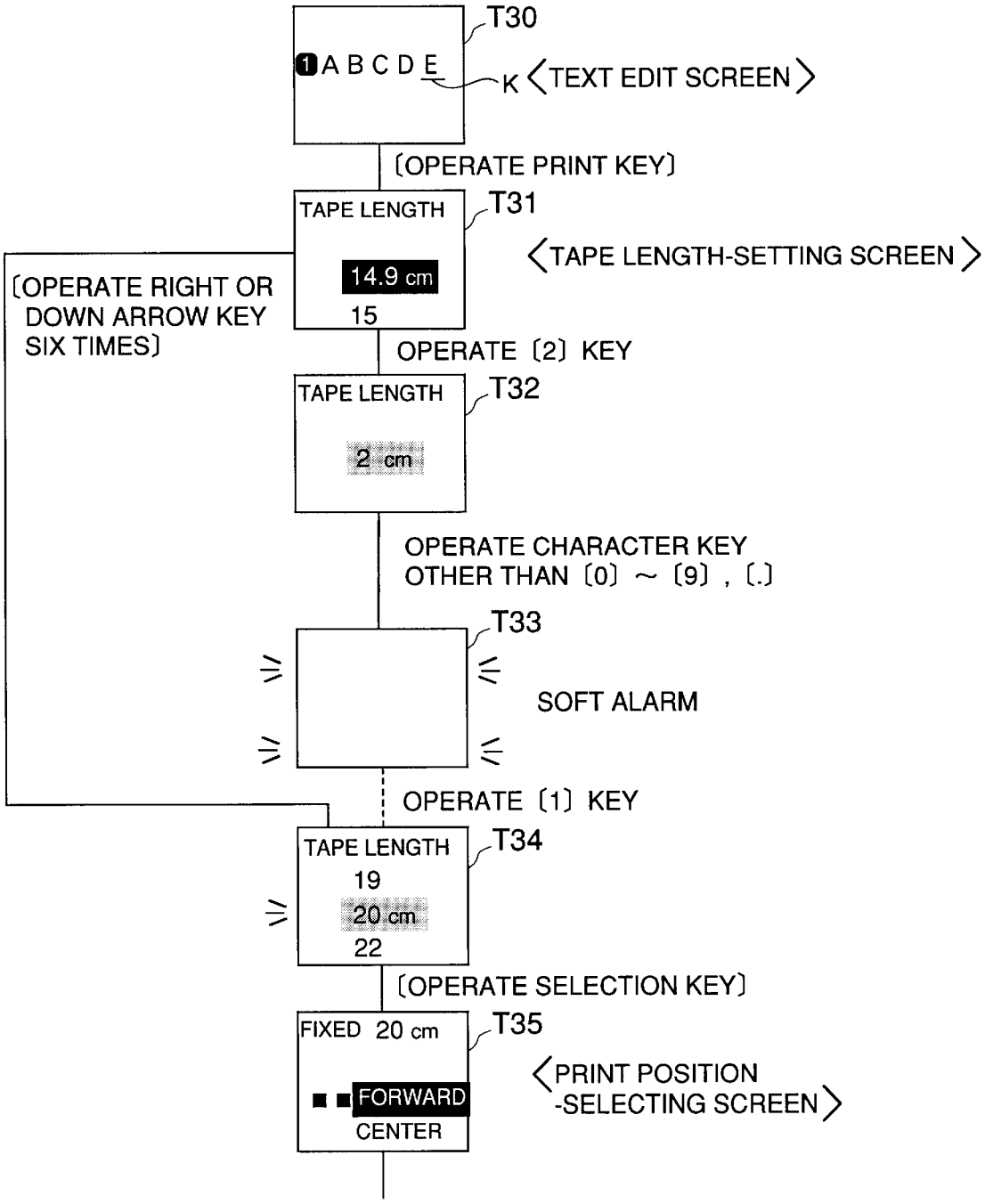
FIG. 4 is a diagram similar to FIG. 3, which illustrates another example of a sequence of screens displayed during the setting process.

Next, a case where a tape length is set by entering numerical values will be described with reference to FIG. 4. First, if the print key is depressed when the text edit screen displays a character string "ABCDE" entered by the user (T30), the screen is switched to a tape length-setting screen on which the "value S" ("14.9 cm, in this example) is displayed in a highlighted manner (T31). Assuming now that when a tape length desired by the user is "21 cm", first, a numerical value "2" is entered by depressing a number key of "2", whereupon the screen is switched to an entry screen for entering numerical values on which not options but the entered numerical value "2" is displayed in a shaded manner (T32). It should be noted that in this state of the entry screen, a soft alarm is issued if characters other than numerical values "1" to 9" and a dot "." are entered. Here, if an additional entry of the numerical value "1" is made, since the candidates do not include "21 cm", as shown in FIG. 9, a largest one of the candidates below the entered value "21" ("20 cm", in the illustrated example) is displayed in a shaded manner (T34). It should be noted that values of the candidate tape lengths other than the value S which are equal to or larger than "10 cm" are displayed in integers.

Then, when the selection key is depressed, the screen is switched to a print position-selecting screen (T35: the same as T23 in FIG. 3). It should be noted that a tape length can be also set by using the cursor key 330 similarly to the case described above with reference to FIG. 3. In this case, the right arrow key or the down arrow key is depressed six times from the state of the screen (T31) of "14.9 cm" (see FIG. 9), whereby the display screen proceeds to the screen T34.

Figure 5:
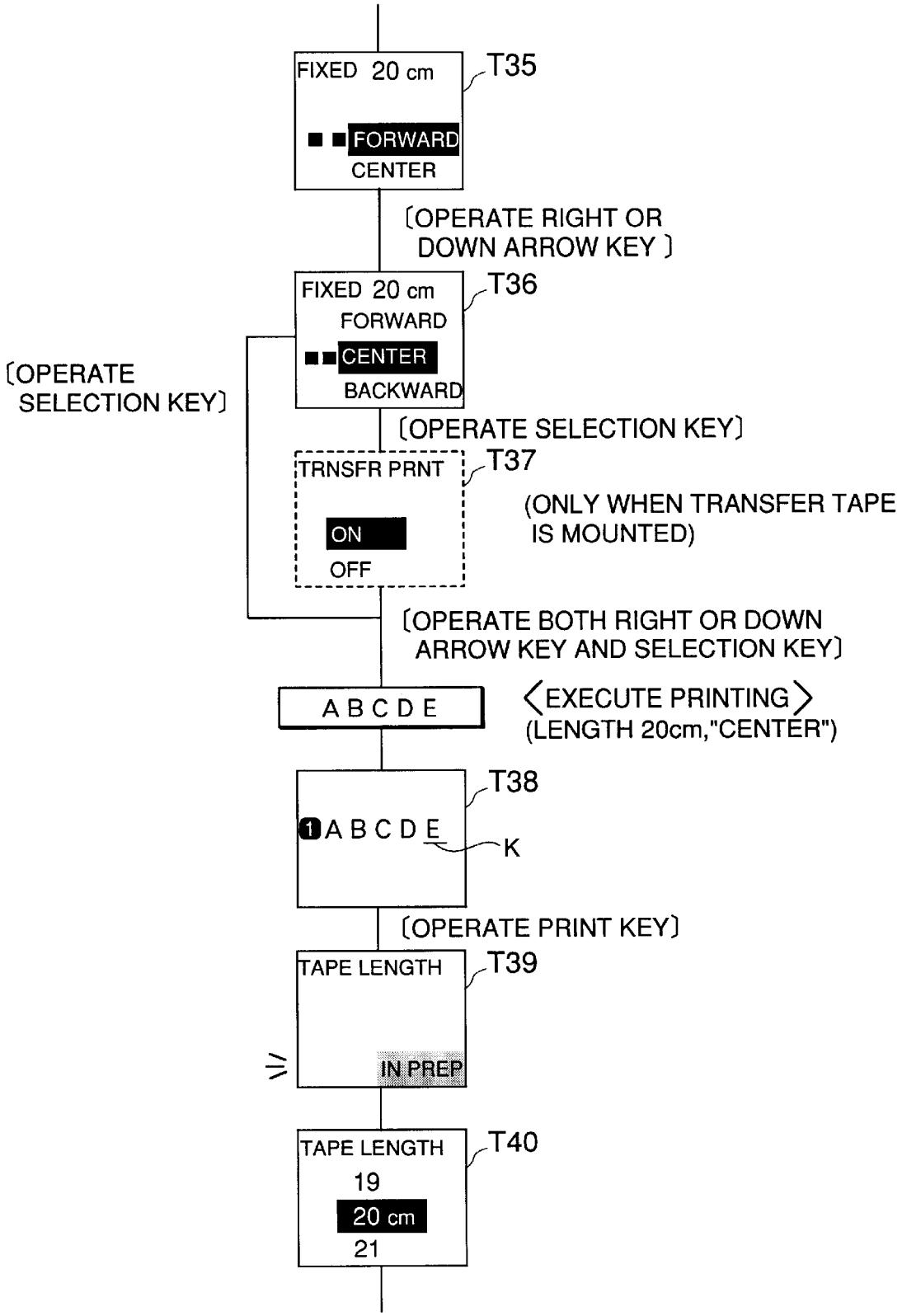
FIG. 5 is a continuation of the FIG. 4 diagram.

Next, an operating procedure for selecting a print position for carrying out printing will be described with reference to FIGS. 5 and 6. In the state of the print position-selecting screen (T35: commonly shown in FIGS. 4 to 6) being displayed, a print position can be selected from the options of "FORWARD", "CENTER", "BACKWARD", and "JUSTIFY". The selection is carried out by operating the cursor key 330. In an illustrated example, the option "CENTER" is selected by once depressing the right arrow key or the down arrow key (T36). If the selection key is depressed, only when a transfer tape is mounted, the screen is switched to a selection screen for selecting whether or not transfer printing ("TRNSFR PRNT") is to be carried out (T37). This selection is effected by operating the cursor key 330. Here, let it be assumed that the right arrow key or the down arrow key (T36) is depressed once to select an option "OFF" (which means transfer printing is not to be carried out). Thereafter, when the selection key is depressed, printing is carried out. It should be noted that if a transfer tape is not mounted, when the selection key is depressed from the state of the screen T36, printing is executed without effecting any further setting step, whereby the character string "ABCDE" is printed on the tape T in a format of tape length "20 cm" and "CENTER" alignment.

The screen returns to the text edit screen (T38) upon completion of the printing. In this state, if the print key is depressed again, the characters "IN PREP" blink on a tape length-setting screen (T39). Since the printing is to be carried out now a second time, the option "20 cm" selected the last time is highlighted as a default (T40), differently from the case of the first-time printing described above. Then, the same operating procedure as described with reference to the FIG. 4 screen T34 et seq. is followed.

Figure 6:
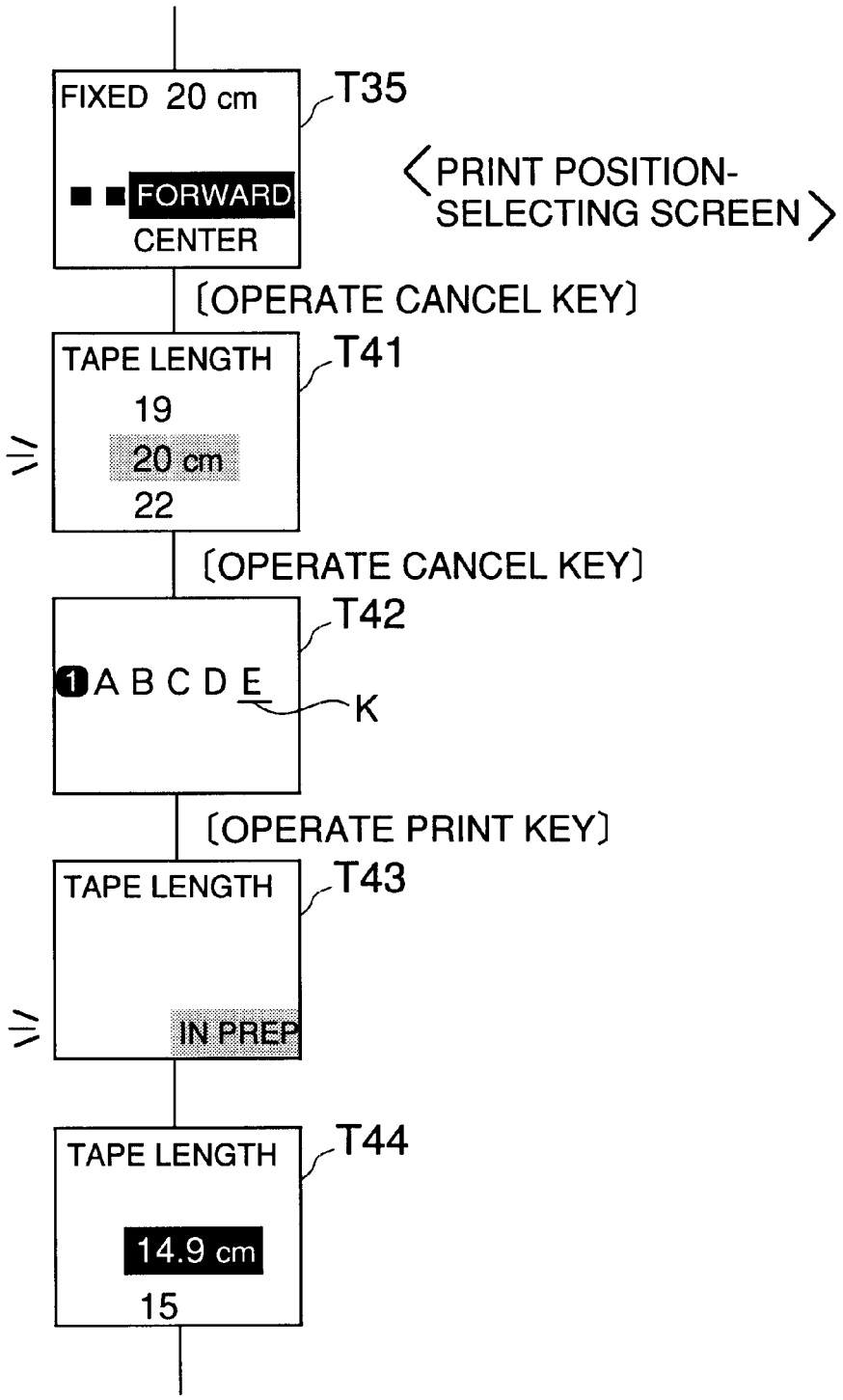
FIG. 6 is a continuation of the FIG. 4 diagram, which illustrates another example of a sequence of screens displayed during the setting process.

Now, as shown in FIG. 6, if the cancel key is depressed without selecting a print position (without depressing the selection key) in the state of the print position-selecting screen (T35) being displayed, the screen returns to the tape length-setting screen (T41) which is at a level immediately above the print position-selecting screen (T35) in terms of hierarchy of screens for display. If the cancel key is depressed once more, the screen returns to the text edit screen (T42)hierarchically still higher by one level. In this state, if the print key is depressed, the characters "IN PREP" blink on the tape length-setting screen since this is a first time to carry out the printing. Then, the "value S" ("14.9 cm") is highlighted as a default (T44). This is because the default value is updated when the selection key is depressed in the state of the print position-selecting screen (T35, T36 or the like). In this case, since the selection key has not been depressed after the print key was depressed last time, the value set as the default is not updated and the "value S" ("14.9 cm") is displayed.

Figure 7:
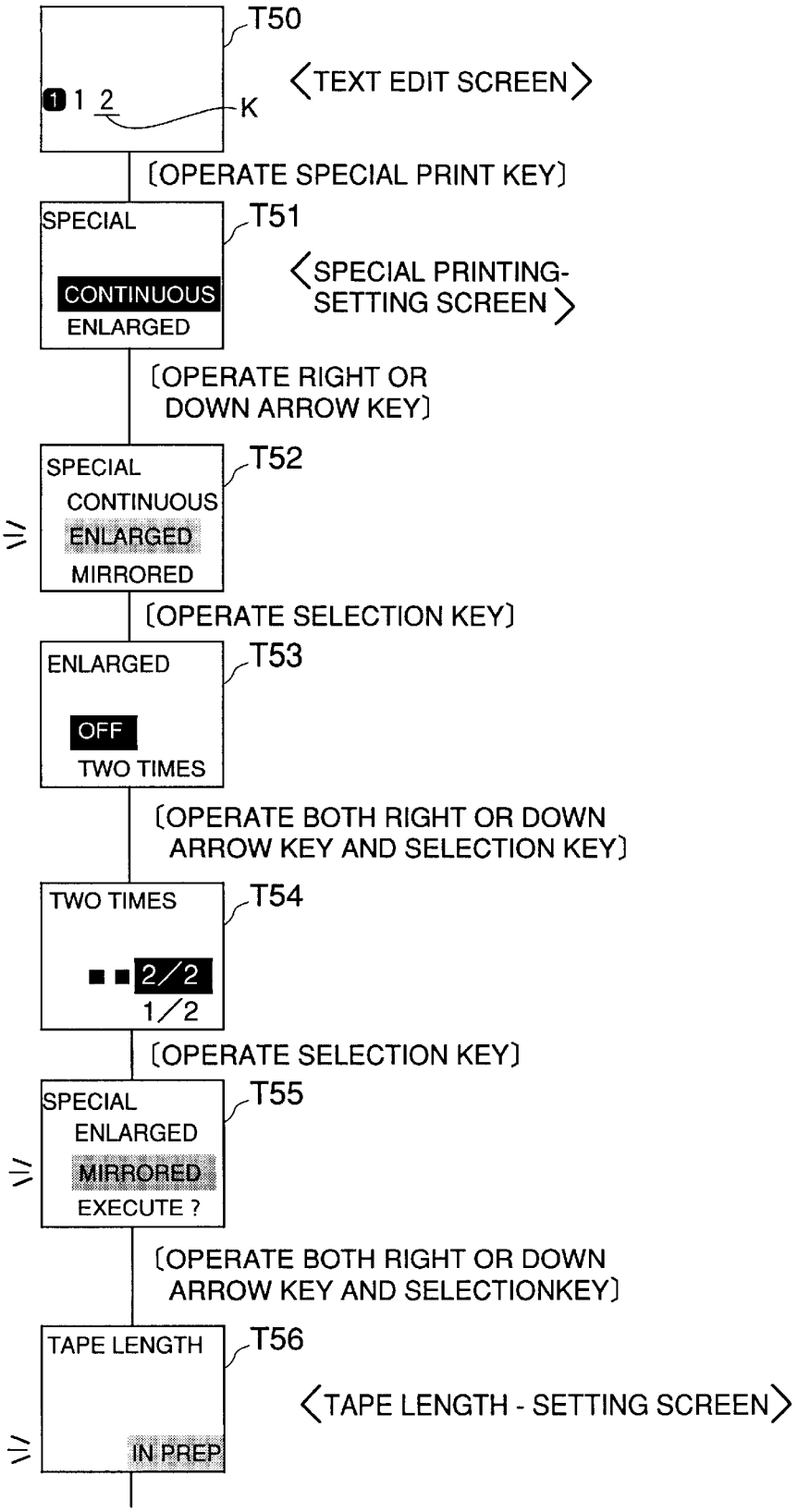
FIG. 7 is a diagram similar to FIG. 3, which illustrates an example of a sequence of screens displayed during a setting process for setting special fixed length printing, which is useful in explaining a typical operating procedure for execution of the setting process.

Next, an operating procedure for carrying out the "fixed length printing" in special printing will be described with reference to FIGS. 7 and 8. First, if the print key is depressed when the text edit screen displays the character string "12" entered by the user (screen T50), the screen is switched to a special printing-setting screen. A character string "SPECIAL" (special printing) is displayed in the heading area at the top of the screen, while options of the special printing are displayed below the heading "SPECIAL", and one of the options, "CONTINUOUS" (continuous printing) is highlighted (T51). One mode of the special printing can be selected from the options of "CONTINUOUS", "ENLARGED" (enlarged printing) and "MIRRORED" (mirrored character printing). In the present case, it is assumed that the option "ENLARGED" is selected by operating the cursor key 330, and the selection key is depressed in the state of "ENLARGED" being displayed in a shaded manner (T52). In the heading area at the top of the screen is displayed "ENLARGED", and options for the enlarged printing are displayed below the heading "ENLARCED" with one option "OFF" being highlighted (T53). From this state, one mode of the enlarged printing can be selected from the options of "OFF" (enlarged printing is not to be carried out, "TWO TIMES" (two times larger), "THREE TIMES" (three time larger), and "FOUR TIMES" (four times larger). Now, if "TWO TIMES" is selected by operating the cursor key 330, and the selection key is depressed in a state of "TWO TIMES" being displayed in a shaded manner, "TWO TIMES" is displayed in the heading area at the top of the screen, and options of "TWO TIMES" are displayed below the heading "TWO TIMES" with one option "2/2" being highlighted (T54). From this state, one mode of the enlarged printing can be selected from the options of "2/2", "1/2", and "2/1". It should be noted that "1/2" designates "enlargement factor of "one" in the vertical direction/enlargement factor of "two" in the horizontal direction". In the illustrated example, it is assumed that the option "2/2" is selected, and the selection key is depressed in the state of "2/2" being highlighted.

After settings of the enlarged printing have been made, the screen returns to the special printing-setting screen to highlight the option "MIRRORED" as a next special printing option to be set (T55). It is assumed here that no other option of the special printing than the enlarged printing is set, and hence the cursor key is operated to select an option "EXECUTE?", which is then displayed in a shaded manner, followed by depressing the selection key. This switches the screen to a tape length-setting screen while causing "IN PREP" to blink (T56; commonly shown in FIG. 8).

Figure 8:
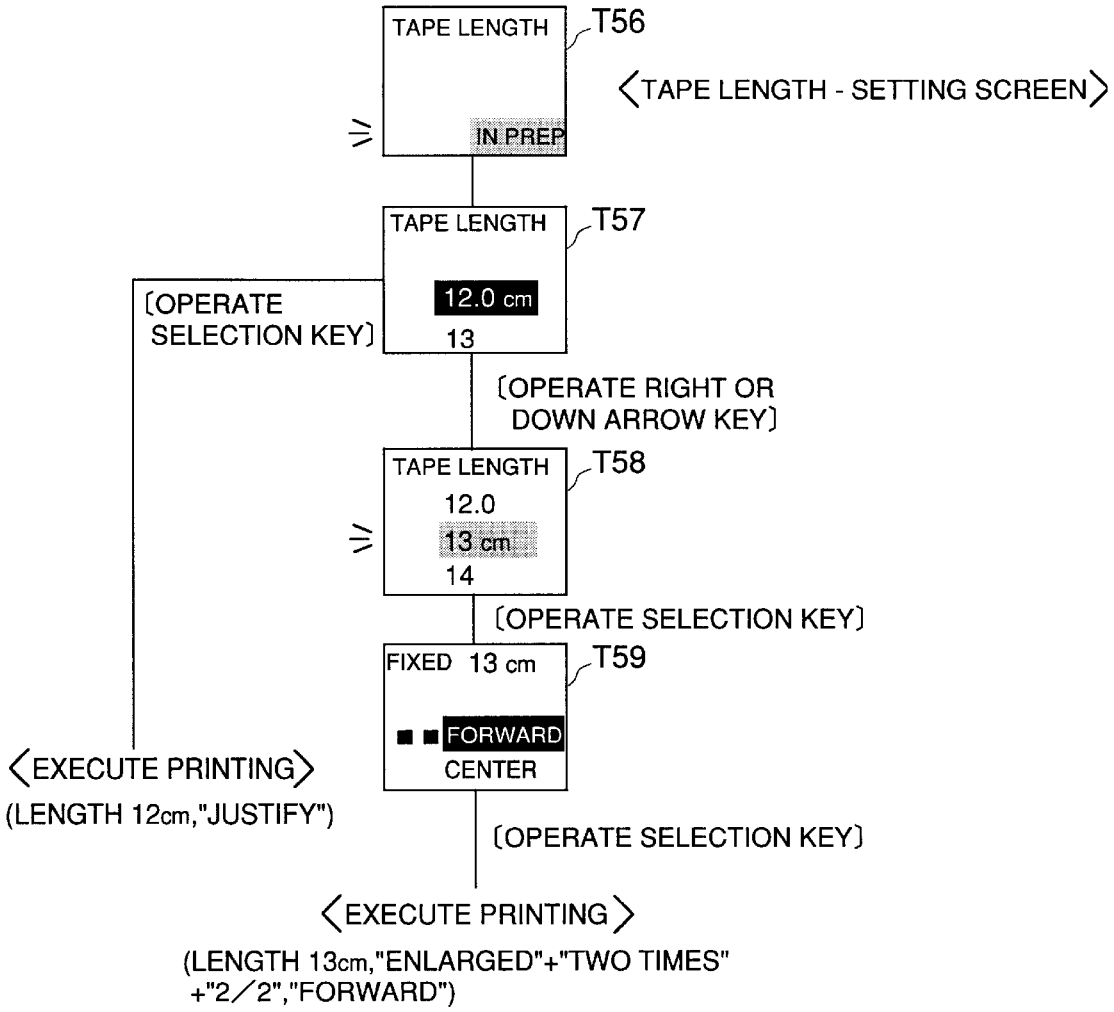
FIG. 8 is a continuation of the FIG. 7 diagram.

Then, as shown in FIG. 8, the "value S" (12.0 cm, in the illustrated example) is highlighted as a default, since this is a first time to carry out the printing (T57). This "value S" is based on the settings of the format ("ENLARGED" (enlarged printing)+"TWO TIMES"+"2/2"). To carry out the printing by using the "value S", the selection key is depressed. In this case, the character string "12" is printed on the tape T in a format of tape length "12 cm", "ENLARGED" (enlarged printing)+"TWO TIMES"+"2/2", and "JUSTIFY".

On the other hand, to carry out the printing by using a value of the fixed tape length other than the "value S", a tape length is set by operating the cursor key 330 or entering a numerical value in a state of a tape length-setting screen ("13 cm" is selected by operating the cursor key 330, in the illustrated example) (T58). Then, the selection key is depressed to switch the screen to a print position-selecting screen (T59). When a print position is selected (the option "FORWARD" is selected in the illustrated example), and the selection key is depressed, the character string "12" is printed on the tape T in a format of tape length "13 cm", "ENLARGED" (enlarged printing)+"TWO TIMES"+2/2", and "FORWARD".

As described hereinabove, according to the invention, a minimum tape length ("value S") over which an arbitrary character string entered can be printed is calculated based on the character string, and a plurality of candidate tape lengths, whose values are equal to or larger than the "value S", are displayed as options, so as to allow the user to select a tape length from the candidates as he desires. Therefore, a tape length not large enough to print thereover an arbitrary character string entered (i.e. smaller in value than the "value S") is prevented from being displayed as a candidate, and only tape lengths over which the entered character string can be printed are displayed, thereby making it possible to prevent a wrong tape length from being erroneously selected. In other words, when printing is instructed, there is no need to repeatedly carry out operations e.g. for changing settings and instructing printing again whenever an error warning is issued.

Further, when the printing is to be carried out a first time, the "value S" is highlighted as a default in preference to other values of the tape length, whereas when the printing is to be carried out a second or later time, "a candidate selected last time" is highlighted as a default in preference to other candidates, so that it is possible to save the trouble of setting a tape length at a second or lower hierarchical level of setting screens. It should be noted that the method of indicating preference of a specific candidate to other candidates in display is not limited to a specific mode of display (highlighting), but it can be realized e.g. by setting a position of display of the specific candidate (in the case of a plurality of candidates being displayed on a single screen at a time) to the top of a list of candidates displayed on the screen, or by setting the order of display of the specific candidate to a first place (in the case of each single candidate being displayed on a corresponding screen).

It should be noted that on the tape length-setting screen at the second hierarchical level, not only the fixed values described above but also predetermined options, such as "MD, 3.5FD" set for a fixed length of 7 cm, and the like, as shown in FIG. 10, maybe further provided. Further, these options may be displayed as pictographic characters (illustrating the MD, for instance) together with numerical values.

Further, the candidate tape lengths may be displayed mainly by respective extra lengths. An extra length is obtained by adding up the lengths of the front and rear margins of a tape (strip of the tape) and lengths of spaces between the characters. Further, the extra length may be displayed together with a corresponding tape length, as in "TAPE 4 cm (including EXTRA 1 cm)", for instance.

Further, the candidate tape lengths may be displayed in representations in which the tape lengths relative to the minimum tape length are indicated not by specific numerical values but by intuitively understandable expressions of lengths (e.g. by referring to a length obtained by adding an extra length 4 cm to the minimum tape length as "LONGER", a length obtained by adding an extra length 2 cm to the minimum tape length as "NORMAL", a length of only the minimum tape length as "SHORTER", and so forth).

Further, the incremental values shown in FIG. 9 can be change as required. For instance, the apparatus may be configured such that any tape length can be set to the first decimal place, when numerical values are entered.

Further, the method of display of a plurality of candidate tape lengths on screens is not limited to that employed in the examples of the present embodiment, but one or mother candidates may be always displayed on the text edit screen during editing. Further, the "value S" may be always displayed on the text edit screen in place of the candidate tape length(s) and it may be updated whenever text data is entered.

Additionally, the apparatus may be configured such that depression of a predetermined key enables printing to be carried out by using the "value S" without switching the screen to any tape length-setting screen located at the second hierarchical level.

It is further understood by those skilled in the art that the foregoing is a preferred embodiment of the invention, and that various changes and modifications may be made without departing from the spirit and scope thereof.

What is claimed is:

1. A tape printing apparatus that is capable of printing a character string on a tape as a medium to be printed upon over a desired tape length, the tape printing apparatus comprising:

input means for inputting a character string including at least one character;

tape length calculation means for calculating a minimum tape length over which said input character string can be printed, before a print command is generated;

candidate tape length display means for displaying a plurality of candidate tape lengths over which said input character string can be printed, dependent on said minimum tape length, the display means displaying the plurality of candidate tape lengths simultaneously and without displaying candidate tape lengths over which said input character string cannot be printed;

tape length selection means for selecting a tape length from said plurality of candidate tape lengths displayed; and printing means for printing said input character string over said selected tape length in response to said print command.

2. A tape printing apparatus according to claim 1, wherein said plurality of candidate tape lengths include a preferential candidate displayed preferentially to other candidates in respect of at least one of a mode of display, a position, and an order of display.

3. A tape printing apparatus according to claim 2, wherein when said plurality of candidate tape lengths includes a tape length selected last time, and wherein said preferential candidate is said tape length selected last time.

4. A tape printing apparatus according to claim 2, wherein said plurality of candidate tape lengths include said minimum tape length, and wherein said preferential candidate is said minimum tape length.

5. A tape printing apparatus according to claim 1, wherein said plurality of candidate tape lengths include a candidate tape length represented by an extra length which is a difference between a whole tape length of said candidate tape length and said minimum tape length.

6. A tape printing apparatus according to claim 5, wherein said plurality of candidate tape lengths include a plurality of candidates each represented by a combination of any two of a sum of said minimum tape length and said extra length, said minimum tape length, and said extra length.

7. A tape printing apparatus according to claim 1, wherein said plurality of candidate tape lengths include a plurality of candidates expressed not by respective specific numerical values but by respective representations of predetermined lengths of areas of articles to which said tape printed with said character string is to be affixed.

8. A tape printing apparatus according to claim 1, wherein said plurality of candidate tape lengths include a plurality of candidates whose tape lengths relative to said minimum tape length are expressed not by specific numerical values but by intuitively understandable expressions of said tape lengths, respectively.

9. A tape printing apparatus according to claim 1, wherein said tape length selection means is permitted to select said tape length from said plurality of candidate tape lengths after said print command has been generated.

10. A tape printing apparatus according to claim 1, wherein said candidate tape length display means displays said plurality of candidate tape lengths after said print command is generated.

11. A tape printing apparatus according to claim 1, further including print position selection means for selecting any one of forward alignment, center alignment, backward alignment, and uniform layout, except when said tape length selected by said tape length selection means is said minimum tape length.

12. A method of setting a tape length, comprising the steps of:

calculating a minimum tape length over which an input character string including at least one character can be printed;

displaying a plurality of candidate tape lengths over which said input character string can be printed, dependent on said minimum tape length, the plurality of candidate tape lengths being displayed simultaneously and without displaying candidate tape lengths over which said input character string cannot be printed; and selecting a tape length from said plurality of candidate tape lengths displayed to set said selected tape length.

* * * * *